United States Patent [19]

Dukes

[11] 4,289,343

[45] Sep. 15, 1981

[54] LOCK FOR SLIDABLE DOOR

[76] Inventor: Connie H. Dukes, 4122 Herschell Rd., Apt. A-6, College Park, Ga. 30337

[21] Appl. No.: 77,482

[22] Filed: Sep. 20, 1979

[51] Int. Cl.[3] ..... E05C 19/00

[52] U.S. Cl. ..... 292/117; 292/251; 292/262

[58] Field of Search ..... 292/117, DIG. 46, 305, 292/90, 206, 105, 212, 251, 262

[56] References Cited

U.S. PATENT DOCUMENTS

| | | | |
|---|---|---|---|
| 311,765 | 2/1885 | Kanmacher | 292/305 X |
| 420,144 | 1/1890 | Countryman | 292/305 |
| 1,580,798 | 4/1926 | Abella et al. | 292/305 |
| 1,851,701 | 3/1932 | Goll | 292/305 |
| 1,874,098 | 8/1932 | Haff | 292/305 |
| 2,314,967 | 3/1943 | Bergesch | 292/251 |
| 2,673,108 | 3/1954 | Roller | 292/144 |
| 4,061,370 | 12/1977 | Hauber | 292/DIG. 46 |

*Primary Examiner*—Richard E. Moore

*Attorney, Agent, or Firm*—Jones, Thomas & Askew

[57] ABSTRACT

A slidable door is fastened in a stationary relationship with respect to its door frame by a mounting plate rigidly attached to the frame, elongated socket connector pivotally mounted at one of its ends to the mounting plate and extending toward the door handle, and a locking element comprising a door handle engagement portion connected to the door handle and a tongue projecting therefrom and extending into the opening of the socket connector. The tongue and socket connector have interengaging lock elements that are biased into engagement with each other by a set screw and/or spring means.

7 Claims, 6 Drawing Figures

Fig. 1
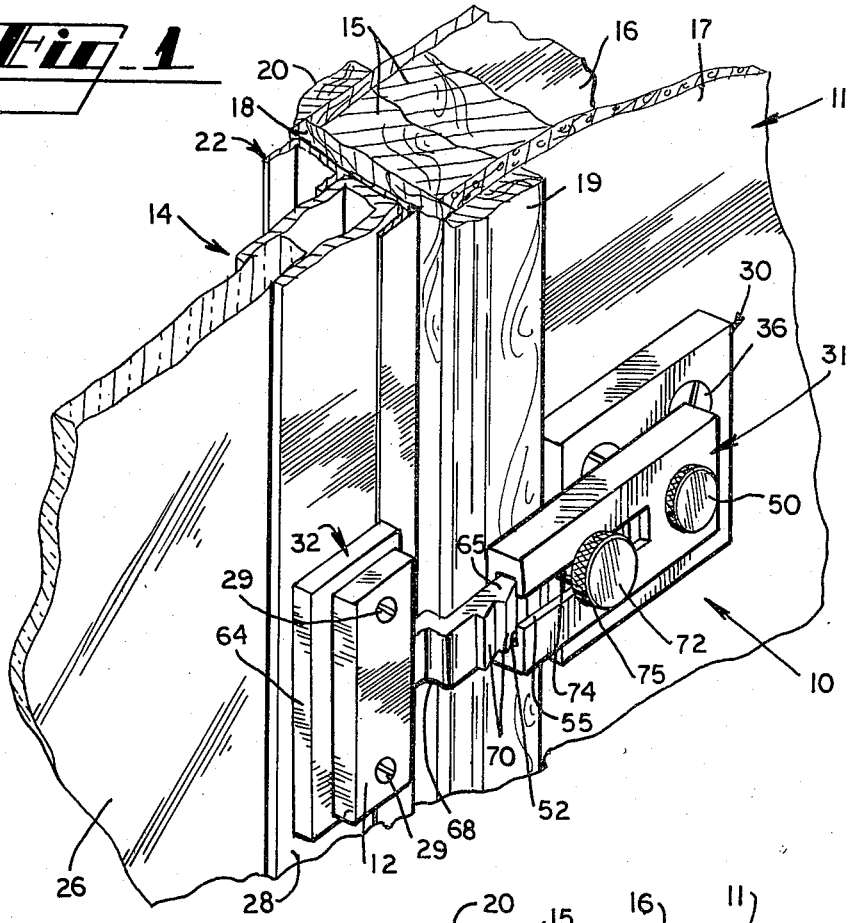
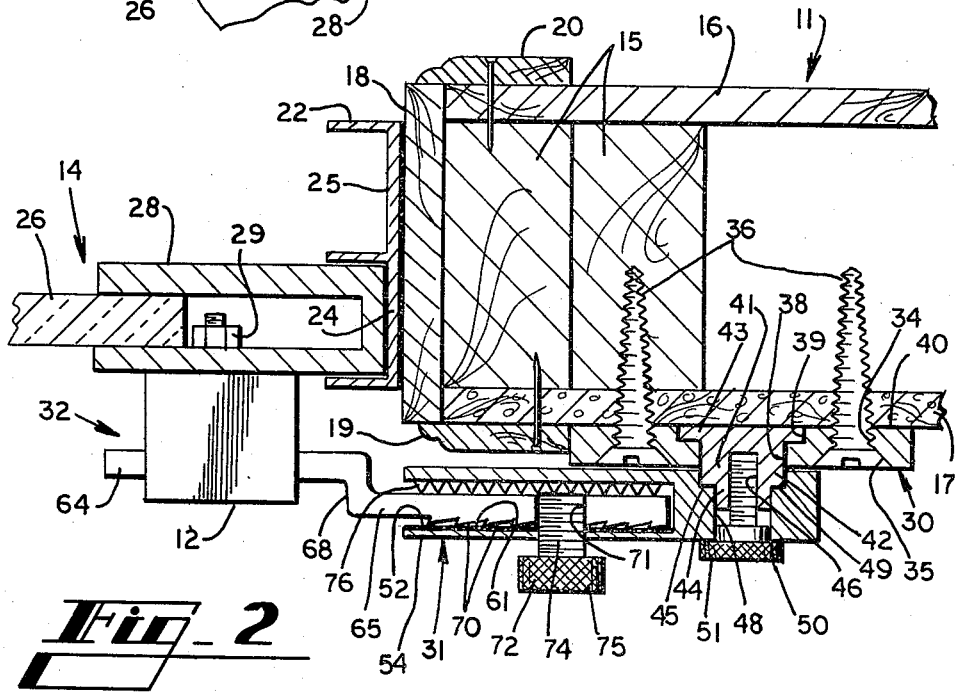
Fig. 2

LOCK FOR SLIDABLE DOOR

BACKGROUND OF THE INVENTION

This invention relates to a door lock assembly for fastening a slidable door in a stationary position with respect to its door frame, wherein the handle of the slidable door is engaged with a locking element, and a tongue of the locking element is releasably received in the opening of an elongated socket connector which is pivotally mounted at one of its ends to a mounting plate fastened to the door frame.

Slidable doors of the type that move along a track in a door frame are difficult to lock securely by the type of lock that is housed within the door frame itself. Usually, a latch is pivotally mounted on the movable door and a keeper is mounted in a stationary position within the frame of the door. When the door is moved into its closed position, the latch engages the keeper to lock the door. If the door is to be forced open without having been unlocked, the typical method of forcing the door is to simply insert a crowbar between the door and its frame and wedge the door open. This tends to destroy the latch, keeper and door frame.

Most of the prior art sliding doors are constructed so that the latch mechanism is located internally of the door and its frame, so that it is not apparent whether the latch has engaged its keeper. Therefore, slidable doors have remained unlocked in some instances through accident or mistake because it was not apparent to someone that the latch had not engaged its keeper.

SUMMARY OF THE INVENTION

Briefly described, the present invention comprises a lock assembly for fastening a slidable door in a stationary position with respect to its door frame which is constructed so that it is mounted exteriorally of a door and of its frame and so that it assumes one attitude when the door is locked and another attitude when the door is not locked. A mounting plate is rigidly fastened to the door frame adjacent the slidable door and an elongated socket connector is pivotally connected at one of its ends to the mounting frame. A locking element comprises a door handle engagement portion for connection to the door handle of the slidable door and a tongue projecting therefrom for insertion into the opening of the pocket connector. The tongue and socket connector include interengaging lock elements that are urged together to rigidly connect the locking element to the socket connector. When the lock assembly is in its locked configuration to hold the door in a fixed position with respect to the door frame, the socket connector and locking element extend horizontally from the mounting plate to the door handle, providing an indication of its locked condition. When the lock assembly is detached from the door handle, the socket connector and locking element pivot to a vertically extending attitude away from the door handle, indicating that it is in its unlocked condition and freeing the door handle from obstruction so that it is free to be grasped and the door can be slid open and closed.

Thus, it is an object of this invention to provide a lock assembly for fastening a slidable door in a stationary position with respect to its door frame, wherein a visual indication is provided by the attitude of the lock assembly with respect to whether the door is locked or unlocked.

Another object of this invention is to provide a lock assembly for securely and rapidly locking a slidable door to its frame.

Another object of this invention is to provide an inexpensive and simply operated lock assembly for expediently fastening a slidable door in a closed position with respect to its door frame.

Other objects, features and advantages of the present invention will become apparent upon reading the following specification, when taken in conjunction with the accompanying drawings.

BRIEF DESCRIPTION OF THE DRAWINGS

FIG. 1 is a perspective illustration of the lock assembly, showing the lock assembly mounted to a door frame and connected to the door handle of a slidable door.

FIG. 2 is a top cross sectional view of the lock assembly and the door frame and its slidable door.

Referring now in more detail to the drawings, in which like numerals indicate like parts throughout the several views, FIG. 1 illustrates the lock assembly 10 which is mounted on a wall structure 11 and is arranged to grasp a door handle 12 of a slidable door 14.

Wall structure 11 can be of any conventional configuration, such as concrete block, drywall, etc. As illustrated in FIGS. 1 and 2, the lock assembly 10 is illustrated as being mounted on a drywall structure that includes vertically extending studs 15, sheets of sheetrock 16 and 17, an end plate 18, and interior and exterior molding strips 19 and 20. The portion of the wall structure 11 illustrated in FIGS. 1 and 2 forms a portion of the door frame which surrounds the door opening of door 14.

Figure 3:
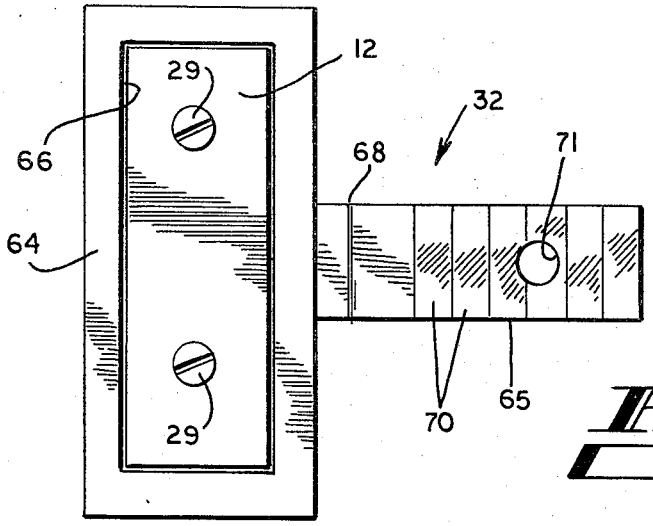
FIG. 3 is a side elevational view of the locking element of the lock assembly.
Figure 4:
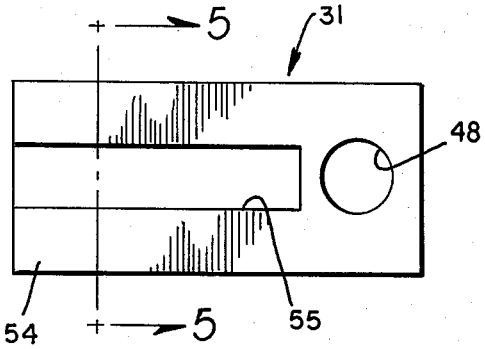
FIG. 4 is a side elevational view of the socket connector of the lock assembly.
Figure 5:
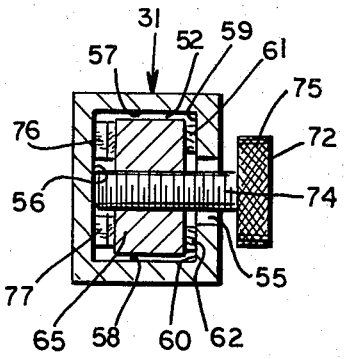
FIG. 5 is an end cross sectional view of the socket connector, tongue of the locking element, set screw and leaf springs.

Door 14 is a slidable door in that it is mounted on upper and lower tracks (not shown) and slides into a vertical frame element 22 which abuts the wall structure 11. Usually, the door structure is a two paneled structure, with one panel being offset from the other so that they can slide past each other. Thus, frame element 22 is formed with a receptable 24 for the interior door 14 and a receptacle 25 for the exterior door (not shown). Door 14 includes a glass panel 26 mounted in a frame 28, with the frame and glass panel being movable in unison on the tracks of the door frame.

In the embodiment disclosed herein, door handle 12 is illustrated as being the type of handle that protrudes outwardly from the frame 28 of the door 14, with the door handle 12 being rigidly fastened to frame 28 by means of bolts 29. However, it will be understood that handle 12 can be of various different shapes, and a handle can be constructed by forming a recess in the frame 28 of door 14, if desired.

Figure 6:
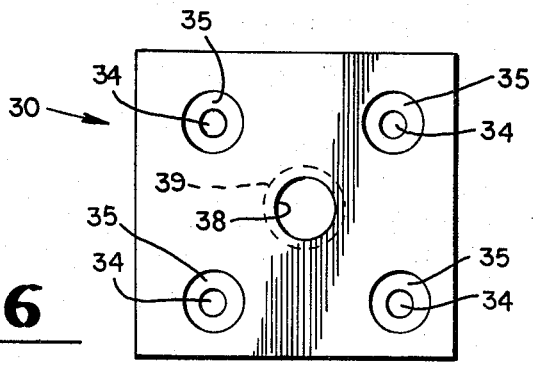
FIG. 6 is a side elevational view of the mounting plate of the lock assembly.

Lock assembly 10 includes mounting plate 30, socket connector 31 and locking element 32. Mounting plate 30 (FIGS. 1, 2 and 6) is substantially flat and rectangular and defines a plurality of openings 34 extending therethrough, each of the openings including a tapered counter bore 35. Connector screws 36 are projected through openings 35 and fasten the mounting plate to the door frame. In the illustrated embodiment, the connectors 36 extend through the sheetrock 17, and at least some of the connectors 36 extend into a stud 15. The mounting plate 30 is positioned in abutment with the interior molding 19 at the door frame, so that the mounting plate 30 derives some of its support from the molding strip 19. A pivot opening 38 extends through the central portion of mounting plate 30 and comprises a counter bore 39 adjacent its back surface 40. Swivel cap 41 comprises cylindrical body 42, cylindrical cap 43 and reduced projection 44 that forms annular shoulder 45. Swivel cap 41 is inserted through pivot opening 38 from the back surface 40 of mounting plate 30, with the cylindrical cap 43 received in the counter bore 39 of pivot opening 38 and with the cylindrical body 42 projecting out of the pivot opening 38. An internal threaded bore 46 is formed in swivel cap 41.

Socket connector 31 (FIGS. 1,2,4 and 5) is elongated and includes at one end portion thereof a swivel opening 48, with the back surface of the socket connector including a counter bore 49. The swivel opening 48 of socket connector 31 is mounted on swivel cap 41 with the annular shoulder of the counter bore 49 engaging the annular shoulder 45 of the swivel cap 43. Connector screw 50 is threaded into the threaded bore 46 of swivel cap 41 so that its enlarged cap forces socket connector onto the swivel cap 41. With this arrangement, the socket connector 31 is pivotally mounted to mounting plate 30 and it is free to hang in a downward direction from the mounting plate or can be moved up in a horizontal attitude to a locking position, as illustrated in the drawings.

Socket connector 31 defines an end opening 52 which extends inwardly from the free end 54 of the socket connector toward pivot opening 38. Elongated slot 55 also extends from the free end portion 54 along the length of socket connector 31, with the elongated slot 55 intersecting the end opening 52. Thus, swivel connector 31 is approximately C-shaped in cross section (FIG. 5), with its end opening 52 formed by the bottom surface 56, opposed side surfaces 57 and 58 and spaced overlying surfaces 59 and 60 that are located on opposite sides of slot 55. Lock protusions 61 and 62 are formed on spaced overlying surfaces 59 and 60.

Locking element 32 (FIGS. 1,2,3, and 4) comprises a door handle engagement portion 64 and a tongue 65. Door handle engagement portion 64 is sized and shaped to correspond approximately to the size and shape of the door handle 12. In the embodiment disclosed herein, the door handle engagement portion is rectangular and defines an opening 66 therein for insertion about the door handle 12. Tongue 65 extends from the door handle engagement portion 64 and includes a z-shaped bend 68 that locates the main body portion of tongue 65 in a different plane from the door handle engagement portion 64. The outer surface of tongue 65 includes corrugated projections 70 at spaced intervals along its length, and a threaded set screw bore 71 is located at the distal end of tongue 65. Set screw 72 includes a threaded shank 74 that projects inwardly of the threaded set screw bore 71 and a cap 75.

Leaf springs 76 and 77 are mounted to the bottom surface 56 of the end opening 52 of the socket connector 31, with each leaf spring being positioned adjacent a side surface 57 or 58, leaving a space between the leaf springs against which the end of set screw 72 can bear. Leaf springs 76 and 77 urge tongue 65 away from bottom surface 56 of socket connector 31 so that its corrugated projections 70 are biased into locking engagement with the lock protrusions 61 which are formed on the spaced overlying surfaces 59 and 60 of swivel connector 31. Thus, with the corrugated projection 70 functioning as lock elements and with lock protrusions 61 functioning as lock elements, and with the lock elements biased into engaging relationship with respect to each other by leaf springs 76 and 77 and by set screw 72, the tongue 65 is restrained from longitudinal movement with respect to socket connector 31.

When lock assembly 10 is to be used to lock the slidable door 14 into a fixed relationship with respect to its door frame, the locking element 32 is inserted about door handle 12, and the socket connector 31 is aligned with the tongue 65 of the locking element 32, and the door and locking element move toward socket connector 31 until the tongue 65 is received in telescoped relationship into the end opening 52 of the socket connector. The set screw 72 passes through the elongated slot 55. When the slidable door 14 is in its desired location, set screw 72 can be tightened, thus forcing tongue 65 out against the spaced overlying surfaces 59 and 60 of the socket connector. Thus, the lock elements 70 of the tongue 65 and the lock elements 61 of the socket connector are urged into locked relationship with respect to one another. Additionally, leaf springs 76 and 77 bias the lock elements together.

When the lock assembly 10 is to be released so that the door 14 can be opened, the set screw 72 is loosened and the set screw and tongue are pressed inwardly against leaf springs 76 and 77 so that the lock elements 70 of the tongue are moved away from the lock elements 61 of the socket connector 31 and the tongue is able to move along the length of the socket connector. If necessary, the tongue can be moved entirely out of socket connector 31 during the unlocking function; however, the tolerances of the swivel cap 41 are likely to provide enough play in the lock assembly to permit the locking element 32 to be moved away from door handle 12 a distance sufficient to permit the door handle to slip out of the opening 66 of the door handle engagement portion 64 when the door handle engagement portion is moved to its furtherest position out of the socket connector.

While door handle engagement portion 64 of locking element 32 is illustrated to receive a rectangular protruding handle 12 of door 14, the configuration of door handle engagement portion 64 can be modified to conform to the configuration of the particular door handle to be engaged. For example, if the door handle is formed in a round shape or is formed as a recess in the frame 28 of the door 14, the door handle engagement portion 64 can be formed in a corresponding round shape or in a corresponding protrusion that projects into the recess of the door handle.

When the lock assembly 10 has been released from the door handle, the socket connector 31 and locking element 32 tend to pivot on its swivel cap 41 to a vertical attitude, causing the locking element 32 to move away from the door handle 12. This leaves the door handle unencumbered by the lock assembly and a visual indication is provided which shows the lock assembly is not connected to the door handle. The springs 66 and 67 continuously bias the lock elements 61 and 70 together so as to prevent the locking element 32 from falling out of the socket connector 31.

It should be understood that the foregoing relates only to a preferred embodiment of the present invention and that numerous modifications or alterations may be therein without departing from the spirit and the scope of the invention as set forth in the appended claims.

I claim:

1. A lock assembly for fastening a slidable door in a stationary position with respect to its door frame comprising a mounting plate for rigid attachment to the frame of a slidable door, an elongated socket connector pivotally mounted to said mounting plate for extending from said mounting plate toward the handle of the slidable door, said socket connector including an opening extending from one end of said socket connector inwardly into said socket connector, a locking element comprising a door handle engagement portion and a tongue extending therefrom, said door handle engagement portion comprising means for connection to the handle of a door, said tongue being sized and shaped to be received in the opening of said socket connector, and means for releasably connecting together said socket connector and said tongue whereby the door handle is fastened in a fixed relationship with respect to the door frame.

2. A lock assembly for fastening a slidable door in a stationary position with respect to its door frame comprising a mounting plate for rigid attachment to the frame of a slidable door, an elongated socket connector pivotally connected to said mounting plate for extending from said mounting plate toward the handle of the slidable door, said socket connector including an opening extending from one end of said socket connector inwardly into said socket connector, and a slot extending along its length and which intersects the opening of said socket connector, a locking element comprising a door handle engagement portion and a tongue extending therefrom, said door handle engagement portion comprising means for connection to the handle of a door, said tongue being sized and shaped to be received in the opening of said socket connector, and means for releasably connecting together said socket connector and said tongue comprising a set screw threaded through said tongue and slidable through said slot for engagement with said socket connector whereby the door handle is fastened in a fixed relationship with respect to the door frame.

3. The lock assembly of claim 1 and wherein said socket connector includes a slot extending along its length and which intersects the opening of said socket connector whereby said socket connector is C-shaped in cross section with a bottom surface, side surfaces and spaced overlying surfaces, said overlying surfaces including lock elements thereon facing said bottom surface, said tongue including lock elements thereon facing the overlying surfaces of socket connector, and spring means positioned between said tongue and the bottom surface of said socket connector for urging together the lock elements of said overlying surfaces of said socket connector and the lock elements of said tongue.

4. The lock assembly of claim 3 and further comprising a set screw threaded through said tongue for frictional engagement with the bottom surface of said socket connector.

5. A lock assembly for fastening a slidable door in a stationary position with respect to its door frame comprising a mounting plate for rigid attachment to the frame of a slidable door, an elongated socket connector pivotably mounted at one of its ends to said mounting plate and defining an opening extending inwardly therein from its other end, a locking element comprising a door handle engagement portion shaped to engage the handle of the sliding door and a tongue extending therefrom, said tongue and said opening being sized and shaped to slide together in a telescoped relationship, said tongue and said opening including inner engaging lock elements for holding said tongue and said socket connector in a fixed relationship with respect to each other, and means for urging the lock elements of said tongue and said opening into engagement with each other.

6. The lock assembly of claim 5 and wherein said means for urging the lock elements of said tongue and said opening into engagement with each other comprises spring means positioned in said opening and biasing the tongue toward engagement with the lock elements of said socket connector.

7. The lock assembly of claim 5 and wherein said socket connector comprises a slot extending along its length, wherein said means for urging the lock elements of said tongue and said opening into engagement with each other include a set screw threaded through said tongue and protruding through said slot.

* * * * *